US009142872B1

(12) United States Patent
Izadian

(10) Patent No.: US 9,142,872 B1
(45) Date of Patent: Sep. 22, 2015

(54) REALIZATION OF THREE-DIMENSIONAL COMPONENTS FOR SIGNAL INTERCONNECTIONS OF ELECTROMAGNETIC WAVES

(71) Applicant: Google Inc., Mountain View, CA (US)

(72) Inventor: Jamal S. Izadian, San Jose, CA (US)

(73) Assignee: Google Inc., Mountain View, CA (US)

( * ) Notice: Subject to any disclaimer, the term of this patent is extended or adjusted under 35 U.S.C. 154(b) by 211 days.

(21) Appl. No.: 13/854,190

(22) Filed: Apr. 1, 2013

(51) Int. Cl.

| | |
|---|---|
| ***H01P 5/12*** | (2006.01) |
| ***H01P 5/20*** | (2006.01) |
| ***H01P 11/00*** | (2006.01) |
| ***H01P 3/00*** | (2006.01) |

(52) U.S. Cl.
CPC ..... *H01P 11/003* (2013.01); *H01P 3/00* (2013.01)

(58) Field of Classification Search
CPC ..... H01P 5/20; H01P 5/16; H01P 1/161; H01P 1/2131; G01R 27/04
USPC ..... 333/121, 122
See application file for complete search history.

(56) References Cited

U.S. PATENT DOCUMENTS

| | | | | |
|---|---|---|---|---|
| 3,854,083 | A * | 12/1974 | Hulderman et al. | 333/218 |
| 4,918,411 | A | 4/1990 | Staehlin et al. | |
| 5,977,924 | A | 11/1999 | Takei | |
| 5,982,256 | A | 11/1999 | Uchimura et al. | |
| 6,285,335 | B1 | 9/2001 | Snygg | |
| 6,822,534 | B2 | 11/2004 | Uriu | |
| 7,215,007 | B2 | 5/2007 | McKinzie, III | |
| 7,227,428 | B2 | 6/2007 | Fukunaga | |
| 8,040,286 | B2 | 10/2011 | Matsuo | |
| 8,188,805 | B2 | 5/2012 | Nomura | |
| 8,212,580 | B2 | 7/2012 | Izadian | |
| 2006/0226931 | A1 * | 10/2006 | Tavassoli Hozouri | 333/117 |
| 2007/0262828 | A1 | 11/2007 | Fujita | |

(Continued)

FOREIGN PATENT DOCUMENTS

| | | |
|---|---|---|
| JP | 2001156510 | 6/2001 |
| WO | 2009023551 | 2/2009 |

OTHER PUBLICATIONS

Non-Final Office Action issued in connection with Co-Pending U.S. Appl. No. 13/851,469 dated Jan. 20, 2015.

(Continued)

*Primary Examiner* — Lincoln Donovan
*Assistant Examiner* — Diana J Cheng
(74) *Attorney, Agent, or Firm* — McDonnell Boehnen Hulbert & Berghoff LLP

(57) ABSTRACT

Example three-dimensional signal interconnections for electromagnetic waves and methods for fabricating the interconnections are described. An example apparatus may include a first conducting layer including a plurality of through-holes, and a first layer between the first conducting layer and a second conducting layer. The first layer may include a plurality of through-holes, and the second conducting layer may also include a plurality of through-holes. The plurality of through-holes of the first layer may at least partially be aligned with the plurality of through-holes of the first conducting layer and the plurality through-holes of the second conducting layer. The apparatus may further include a second layer between the second conducting layer and a third conducting layer. The second layer may have a first waveguide channel and a second waveguide channel substantially perpendicular to and intersecting with the first waveguide channel.

18 Claims, 6 Drawing Sheets

(56) References Cited

U.S. PATENT DOCUMENTS

| | | | |
|---|---|---|---|
| 2008/0150821 | A1 | 6/2008 | Koch |
| 2008/0169349 | A1 | 7/2008 | Suzuki |
| 2009/0309680 | A1 | 12/2009 | Suzuki |
| 2010/0307798 | A1 | 12/2010 | Izadian |
| 2011/0001584 | A1 | 1/2011 | Enokihara |
| 2011/0018657 | A1 | 1/2011 | Cheng |
| 2012/0050125 | A1 | 3/2012 | Leiba |
| 2012/0056776 | A1 | 3/2012 | Shijo |
| 2012/0306598 | A1 | 12/2012 | Izadian |

OTHER PUBLICATIONS

Non-Final Office Action issued in connection with Co-Pending U.S. Appl. No. 13/852,416 dated Jan. 14, 2015.

* cited by examiner

REALIZATION OF THREE-DIMENSIONAL COMPONENTS FOR SIGNAL INTERCONNECTIONS OF ELECTROMAGNETIC WAVES

BACKGROUND

In communications and electronic engineering, a transmission line may include a specialized cable designed to carry alternating current of radio frequency, that is, current with a frequency high enough that the wave nature of the current is taken into account. Transmission lines may be used for purposes such as connecting radio transmitter and receivers with their antennas, distributing cable television signals, and computer network connections, for example.

SUMMARY

The present disclosure includes examples that relate to three-dimensional (3D) signal interconnections and fabrication methods. In one aspect, the present disclosure describes a method. The method may comprise forming a first conducting layer including a plurality of through-holes, and forming a second conducting layer including a plurality of through-holes. The method also may comprise forming, between the first conducting layer and the second conducting layer, a first layer including a plurality of through-holes. The plurality of through-holes of the first layer may be at least partially aligned with the plurality of through-holes of the first conducting layer and the plurality through-holes of the second conducting layer. The method also may comprise forming a third conducting layer. The method further may comprise forming, between the second conducting layer and the third conducting layer, a second layer. The second layer may have a first waveguide channel and a second waveguide channel substantially perpendicular to and intersecting with the first waveguide channel. Respective through-holes in the first conducting layer, the first layer, and the second conducting layer may be configured to define respective electromagnetic wave paths to and from the first waveguide channel and the second waveguide channel.

In another aspect, the present disclosure includes an apparatus. The apparatus may comprise a first conducting layer including a plurality of through-holes. The apparatus may further comprise a second conducting layer including a plurality of through-holes. The apparatus also may comprise a first layer between the first conducting layer and the second conducting layer. The first layer may include a plurality of through-holes. The plurality of through-holes of the first layer may be at least partially aligned with the plurality of through-holes of the first conducting layer and the plurality through-holes of the second conducting layer. The apparatus further may comprise a second layer between the second conducting layer and a third conducting layer. The second layer may have a first waveguide channel and a second waveguide channel substantially perpendicular to and intersecting with the first waveguide channel. Respective through-holes in the first conducting layer, the first layer, and the second conducting layer may be configured to define respective electromagnetic wave paths to and from the first waveguide channel and the second waveguide channel.

In still another aspect, the present disclosure includes another method. The method may comprise forming a first conducting layer including a plurality of through-holes. The method also may comprise forming a second conducting layer including a plurality of through-holes. The method also may comprise forming, between the first conducting layer and the second conducting layer, a layer that has a first waveguide channel and a second waveguide channel substantially perpendicular to and intersecting with the first waveguide channel to form a T-shaped waveguide. Respective through-holes in the first conducting layer and the second conducting layer are configured to define respective electromagnetic wave paths to and from the first waveguide channel and the second waveguide channel The foregoing summary is illustrative only and is not intended to be in any way limiting. In addition to the illustrative aspects, embodiments, and features described above, further aspects, embodiments, and features will become apparent by reference to the figures and the following detailed description.

DETAILED DESCRIPTION

The following detailed description describes various features and functions of the disclosed systems and methods with reference to the accompanying figures. In the figures, similar symbols identify similar components, unless context dictates otherwise. The illustrative system and method embodiments described herein are not meant to be limiting. It may be readily understood that certain aspects of the disclosed systems and methods can be arranged and combined in a wide variety of different configurations, all of which are contemplated herein.

I. Overview

Waves in open space propagate in all directions, as spherical waves. In this manner, the waves lose power proportionally to the square of propagation distance; that is, at a distance R from the source, the power is the source power divided by $R^2$. A waveguide is a structure that guides waves, such as electromagnetic waves or sound waves. For instance, the waveguide may confine a wave to propagate in one dimension, so that, under certain conditions, the wave may lose no power while propagating. There are different types of waveguides for various types of waves. As an example, a waveguide may include a hollow conductive metal pipe used to carry high frequency radio waves or microwaves.

Functions of a waveguide may be determined by geometry of the waveguide. Slab waveguides, for example, may confine energy to travel in one dimension, while fiber or channel waveguides may confine energy to travel in two dimensions. Waves may be confined inside the waveguide due to reflection from walls of the waveguide. In this case, propagation inside the waveguide can be described approximately as a "zigzag" between the walls. This description is applicable, for example, to electromagnetic waves in a hollow metal tube with a rectangular or circular cross-section.

Frequency of the transmitted wave may also dictate the shape of a waveguide. As an example, an optical fiber guiding high-frequency light may not guide microwaves of a much lower frequency. Generally, width of a given waveguide may be of the same order of magnitude as a respective wavelength of the guided wave.

Waveguides can be constructed to carry waves over a wide portion of the electromagnetic spectrum, such as in the microwave and optical frequency ranges. Depending on the frequency, the waveguides can be constructed from either conductive or dielectric materials. Waveguides can be used for transferring both power and communication signals.

One example waveguide structure includes a magic tee (also referred to as magic T or hybrid T), which may include a three-dimensional (3D) structure configured to combine several waveguides into a T-shaped structure. The T-shaped structure can be used to transmit waves in microwaves systems, such as radar systems.

Figure 1:
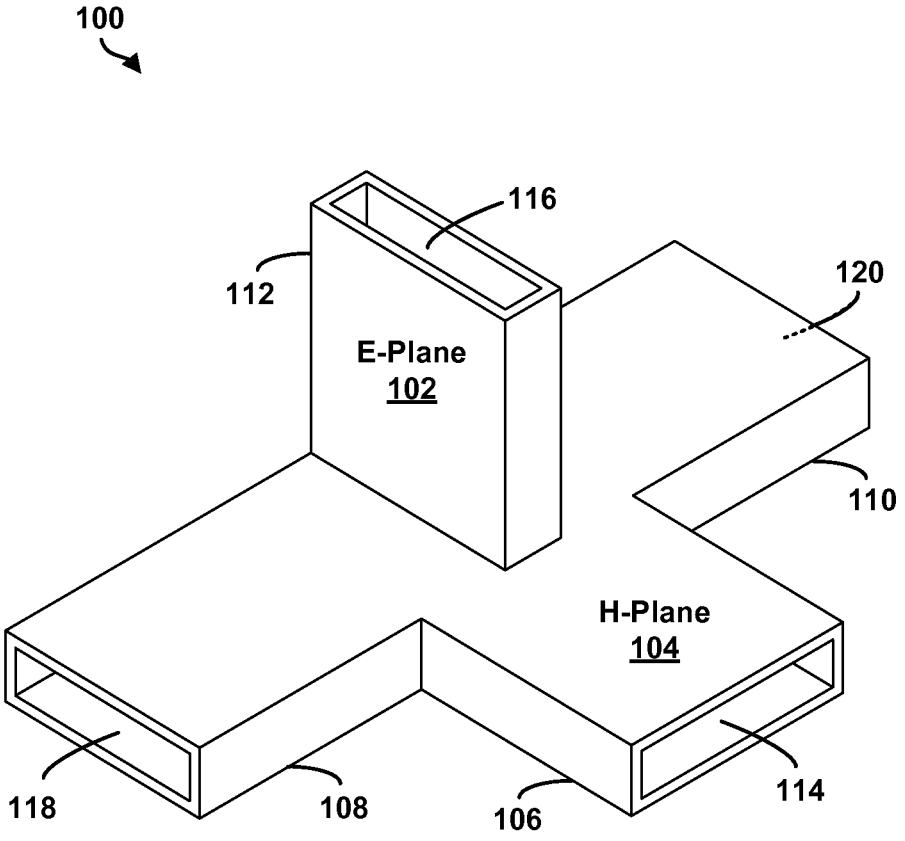
FIG. 1 illustrates an example Magic Tee, in accordance with an example embodiment.

FIG. 1 illustrates an example Magic Tee 100, in accordance with an example embodiment. The Magic Tee 100 includes a combination of E-plane tee 102 and H-plane tee 104. Arm 106, arm 108, and arm 110 form the H-plane tee 104. Arm 112, the arm 108, and the arm 110 form the E-plane tee 102. The arm 108 and the arm 110 may be referred to as 'side arms' or 'collinear arms' of the Magic Tee 100. Port 114 may be referred to as 'H-plane port,' and may also be referred to as 'sigma (E) port,' or 'sum port.' Port 116 may be referred to as 'E-plane port,' and may also be referred to as 'delta (Δ) port,' or 'difference port.'

Functionality of the Magic Tee 100 may be based on the manner in which power is divided among the various ports. For example, a signal injected in to the H-plane port 114 may be divided substantially equally between port 118 and port 120. Divided signals going through the port 118 and the port 120 may be in phase.

In another example, a signal injected in to the E-plane port 116 may similarly be divided substantially equally between the port 118 and the port 120, but the divided signals going through the port 118 and the port 120 may be 180° out of phase. In still another example, if signals are fed in through the ports 118 and 120, they may be combined or added at the H-plane port 114 and subtracted at the E-plane port 116.

Such functionality of the Magic Tee 100 may be based on internal structure of respective waveguides or the arms 106, 108, 110, and 112 that form the Magic Tee 100. For example, based on dimensional and fabrication accuracy of the internal structure of the Magic Tee 100, the E-plane port 116 and H-plane port 114 may be simultaneously matched. In this manner, by symmetry, reciprocity, and conservation of energy, the two collinear arms 108 and 110 may also be matched and isolated from each other.

In examples, electric-field (E-field) of dominant transmission mode in each port may be perpendicular to walls of the respective waveguide. Signals in the E-plane port 116 and H-plane port 114 therefore may have orthogonal polarizations, and so, considering the symmetry of the structure of the Magic Tee 100, there may be no communication between these two ports.

For a signal entering the H-plane port 114, a matched structure may be configured to prevent any portion of the power in the signal from being reflected back out of the same port. As there may be no communication with the E-plane port 116, and again considering the symmetry of the structure, the power in the signal may be divided equally between to the two collinear ports 118 and 120. Similarly, if the matching structure eliminates any reflection from the E-plane port 116, the power entering the E-plane port 116 may be be divided equally between the two collinear ports 118 and 120.

By reciprocity, coupling between any pair of ports may be the same in either direction. Thus, if the H-plane port 114 is matched, half the power entering either one of the collinear ports 118 and 120 may leave through the H-plane port 114. If the E-plane port 116 is also matched, half power may leave by the E-plane port 116. In this circumstance, there may be no power 'left over' either to be reflected out of the first collinear port 118 or to be transmitted to the other collinear port 120. Despite apparently being in direct communication with each other, the two collinear ports are isolated.

Isolation between the E-plane port 116 and the H-plane port 114 may be wide-band, and the degree of isolation may depend on the symmetry of the Magic Tee 100. Thus, performance of the Magic Tee 100 may be commensurate with accuracy of manufacturing or fabrication of the Magic Tee 100. The performance may be a measure of how wide of a dynamic range can be obtained between the Sigma and Delta ports in the configurations of the Magic Tee 100 such as a transmit/receive switch or a monopulse beam forming antennas. The Delta channel is provided the null beam and Sigma channel represents the sum beam.

II. Example Fabrication Methods

A given Magic Tee may be manufactured by machining a metal block, for example, to create the arms and ports. In another example, various components can be designed and fabricated separately, and then assembled to form the Magic Tee. Performance of the Magic Tee may depend on accuracy of manufacture of these components as described above.

Figure 2:
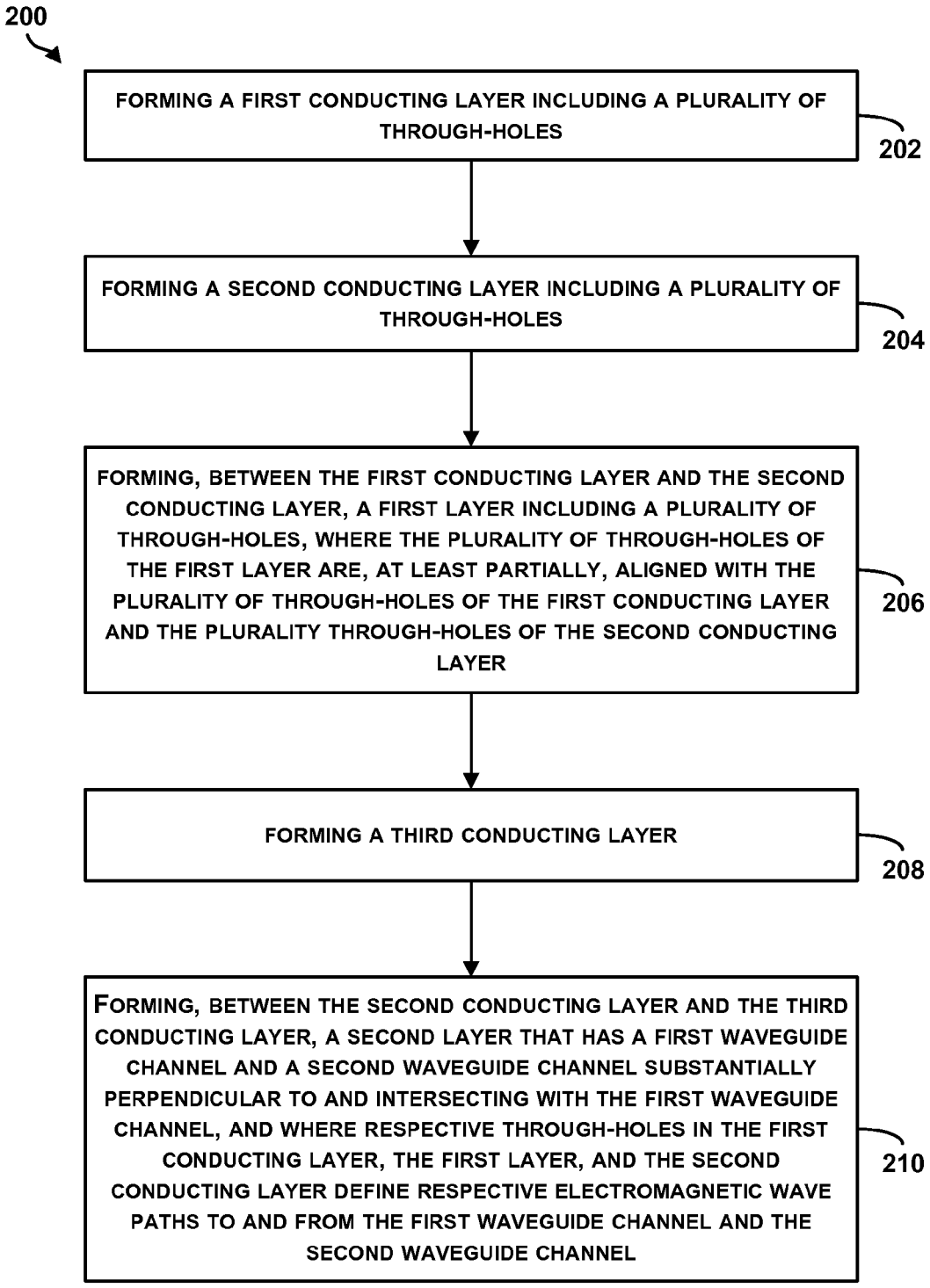
FIG. 2 is a flow chart of a method to form three-dimensional (3D) signal interconnections for electromagnetic waves, in accordance with an example embodiment.

FIG. 2 is a flow chart of a method 200 to form three-dimensional (3D) signal interconnections for electromagnetic waves, in accordance with an example embodiment. The method 200 may provide an additional or alternative manufacturing method of Magic Tees or any other components involving waveguides configured for transmission of electromagnetic waves.

The method 200 may include one or more operations, functions, or actions as illustrated by one or more of blocks 202-210. Although the blocks are illustrated in a sequential order, these blocks may in some instances be performed in parallel, and/or in a different order than those described herein. Also, the various blocks may be combined into fewer blocks, divided into additional blocks, and/or removed based upon the desired implementation.

At block 202, the method 200 includes forming a first conducting layer including a plurality of through-holes. The first conducting layer may, for example, be made of a foil or sheet metal. Example materials may include copper, aluminum, or any other conducting materials. In some examples, the first conducting layer may include a Kapton layer (polyimide film) coupled to a conducting layer. For instance, the combined Kapton layer and conducting layer may form a polyimide copper laminate that has a conducting copper layer on one side coupled to a Kapton layer. In some examples, another conducting copper layer may be coupled to the Kapton layer from the other side of the Kapton layer such that the Kapton layer (polyimide film) is sandwiched between two conducting layers.

Figure 3A:
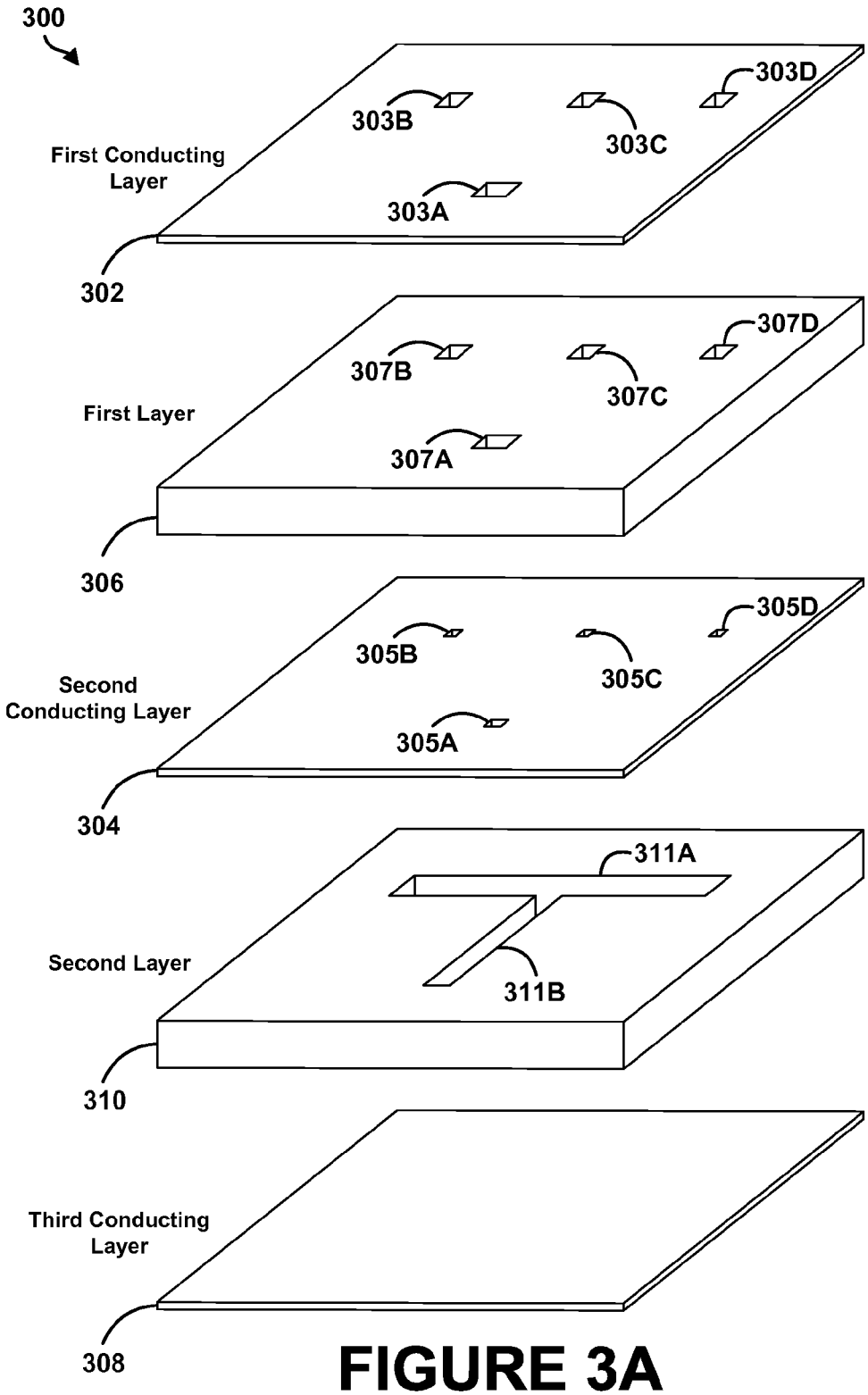
FIG. 3A illustrates an exploded view of different layers of an apparatus that includes 3D signal interconnections, in accordance with an example embodiment.

FIG. 3A illustrates an exploded view of different layers of an apparatus 300 that includes three-dimensional (3D) signal interconnections, in accordance with an example embodiment. FIG. 3A depicts a first conducting layer 302. The first conducting layer 302 may include a plurality of through-holes such as through-holes 303A, 303B, 303C, and 303D. As described above, the first conducting layer 302 may be made of a metallic sheet (or foil), or made of a Kapton layer coupled to a conducting layer. In the example where the first conducing layer 302 may include a combination of a Kapton layer coupled to a conducting layer, the Kapton layer may not have through-holes corresponding to respective through-holes in the conducting layer. The Kapton layer may be configured to radiate or propagate electromagnetic waves without through-holes due to the nature of the Kapton material. Although FIG. 3A depicts four through-holes 303A, 303B, 303C, and 303D, a lesser or greater number of through-holes is possible as well. The depicted through-holes are an example for illustration. The through-holes 303A, 303B, 303C, and 303D may be drilled, etched, or formed using any other manufacturing technique appropriate for the material of the first conducting layer 302. The through-holes 303A, 303B, 303C, and 303D may be of any shape, circular, rectangular, square, etc.

Referring back to FIG. 2, at block 204, the method 200 includes forming a second conducting layer including a plurality of through-holes. FIG. 3A depicts, similar to the first conducting layer 302, a second conducting layer 304 including a plurality of through-holes, such as the through-holes 305A, 305B, 305C, and 305D. The second conducting layer 304 may, for example, be made of a foil or sheet metal like the first conducting layer 302 with similar materials. In an example, the second conducting layer 304 may include a Kapton layer that is laminated from both sides (sandwiched) by copper layers. The through-holes 305A, 305B, 305C, and 305D may be drilled, etched, or formed using any other manufacturing technique appropriate for the material of the second conducting layer 304. The through-holes 305A, 305B, 305C, and 305D may be of any shape, circular, rectangular, square, etc.

Referring back to FIG. 2, at block 206, the method 200 includes forming, between the first conducting layer and the second conducting layer, a first layer including a plurality of through-holes. The plurality of through-holes of the first layer may, at least partially, be aligned with the plurality of through-holes of the first conducting layer and the plurality through-holes of the second conducting layer. FIG. 3A depicts a first layer 306 positioned between the first conducting layer 302 and the second conducting layer 304. The first layer 306 may include a plurality of through-hole, such as through-hole 307A, 307B, 307C, and 307D. As an example, the through-hole 303D of the first conducting layer 302 may be at least partially aligned with the through-hole 307D of the first layer 306, and the through-hole 307D of the first layer 306 may be at least partially aligned with the through-hole 305D of the second conducting layer. The through-holes 307A, 307B, 307C, and 307D may be drilled, etched, or formed using any other manufacturing technique appropriate for the material of the first conducting layer 306. The through-holes 307A, 307B, 307C, and 307D may be of any shape, circular, rectangular, square, etc.

In some examples, the through-holes of a given layer may be of similar size or may have different sizes. Further, a given through-hole in the given layer may be of a similar size to respective through-hole of another layer, or may have different sizes. For instance, the through-holes 305A, 305B, 305C, and 305D of the second conducting layer may have a smaller or larger size compared to the through-holes 307A, 307B, 307C, and 307D of the first layer 306.

In some examples, the first layer 306 may be made of a conducting material such as any metallic material (e.g., copper, aluminum, etc.). In other examples, the first layer 306 may be made of a dielectric material that is laminated with conducting layers on both sides. For instance, the first layer 306 may be made of FR-4 material. FR-4 is a grade designation assigned to glass-reinforced epoxy laminate sheets, tubes, or rods. FR-4 is a composite material composed of woven fiberglass cloth with an epoxy resin binder that is flame resistant (self-extinguishing).

FR-4 glass epoxy is a versatile high-pressure thermoset plastic laminate grade used as an electrical insulator possessing considerable mechanical strength. The FR-4 material may be configured to retain high mechanical values and electrical insulating qualities in both dry and humid conditions. FR-4 epoxy resin may include bromine, a halogen, to facilitate flame-resistant properties in FR-4 glass epoxy laminates. The FR-4 material may be laminated with conducting material (e.g., copper layers) on both sides.

When the first layer 306 is made of a metallic conducting material, inner surfaces (walls) of the through holes 307A, 307B, 307C, and 307D are also metallic. Similarly, when the first layer 306 is made of a dielectric material, even though the dielectric material may be laminated on both sides with conducting layers, the inner surfaces of the through holes 307A, 307B, 307C, and 307D are dielectric. Forming (e.g., drilling) the through-holes 307A, 307B, 307C, and 307D exposes the inner surfaces made of non-laminated internal dielectric material. In these examples, a conducting material (e.g., a metallic material) may be deposited or plated on the inner surfaces of the through-holes 307A, 307B, 307C, and 307D. The plated through-holes 307A, 307B, 307C, and 307D may be configured to provide conductive connections appropriate for propagating electromagnetic waves, for example. Several techniques can be used to deposit or plate the inner surfaces of the through-holes with a conducting material. The through-holes may be preconditioned first. For example, several processes such as desemearing, hole-conditioning, micro-etching, activation, and acceleration can be applied to precondition the through-holes. The first layer 306 may then be dipped in solution where electroless copper can be deposited on the inner surfaces. Other techniques can be used to deposit or plate a metallic or conducting material on the inner surfaces of the through-holes 307A, 307B, 307C, 307D. For instance, techniques used in printed circuit board manufacturing can be used for forming the first layer 306 and depositing a conducting material on respective inner surfaces of the through-holes 307A, 307B, 307C, and 307D.

Referring back to FIG. 2, at block 208, the method 200 includes forming a third conducting layer. FIG. 3A, depicts a third conducting layer 308 that could be made of a materials similar to respective materials of the first conducting layer 302 and the second conducting layer 304. Thus, the third conducting layer 308 may be made as sheet or foil of a conducting material. Alternatively, the third conducting layer 308 may be made of a Kapton layer coupled to a conducting laminate on one or both sides of the Kapton layer.

Referring back to FIG. 2, at block 210, the method 200 includes forming, between the second conducting layer and the third conducting layer, a second layer. The second layer may have a first waveguide channel and a second waveguide channel substantially perpendicular to and intersecting with the first waveguide channel. Further, respective through-holes in the first conducting layer, the first layer, and the second conducting layer may define respective electromagnetic wave paths or waveguides to and from the first waveguide channel and the second waveguide channel.

FIG. 3A depicts a second layer 310 between the second conducting layer 304 and the third conducting layer 308. The second layer 310 includes a first waveguide channel 311A and a second waveguide channel 311B that may be substantially perpendicular to and intersecting with the first waveguide channel 311A. For example, the first waveguide channel 311A and the second waveguide channel 31 lB may be configured to form a T-shaped waveguide configured to receive and propagate electromagnetic waves. In this example, the first waveguide channel 311A may be configured to form two collinear arms of the T-shaped waveguide, and the second waveguide channel 311B may be configured to form a perpendicular leg of the T-shaped waveguide. The first waveguide channel 311A and the second waveguide channel 311B may be drilled, etched, or formed using any other manufacturing process appropriate for the material of the second layer 310.

In an example, the second layer 310 may be made of conducting material (e.g., a metallic material). In another example, the second layer 310 may be made of a dielectric material such as FR-4 material. The FR-4 material, as described with respect to the first layer 306, may be laminated on both sides by a conducting (e.g., copper) laminate. In this example, however, when the first waveguide channel 311A and the second waveguide channel are formed in the second layer 310, inner surfaces of the waveguide channels may not be metallic; instead FR-4 non-laminated dielectric or non-conducting material is exposed. In these examples, a conducting material (e.g., a metallic material) may be deposited or plated on the inner surfaces of the first waveguide channel 311A and the second waveguide channel 311B. As an example for illustration, after forming the waveguide channels, the second layer 310 may be dipped in solution where electroless copper can be deposited on the inner surfaces. As described with respect to the first layer 306, other techniques can be used to deposit or plate a metallic or conducting material on the inner surfaces of the first waveguide channel 311A and the second waveguide channel 311B.

In some examples, the copper laminate on both sides of the FR-4 material can be utilized to form electric signal traces, similar to circuit-board traces, to implement electric circuitry and signal routing functionality. These traces may be formed using printing techniques implementing photolithography, for example. In these examples, the apparatus 300 may be referred to as being made using "Printed Waveguide Transmission Lines."

Figure 3B:
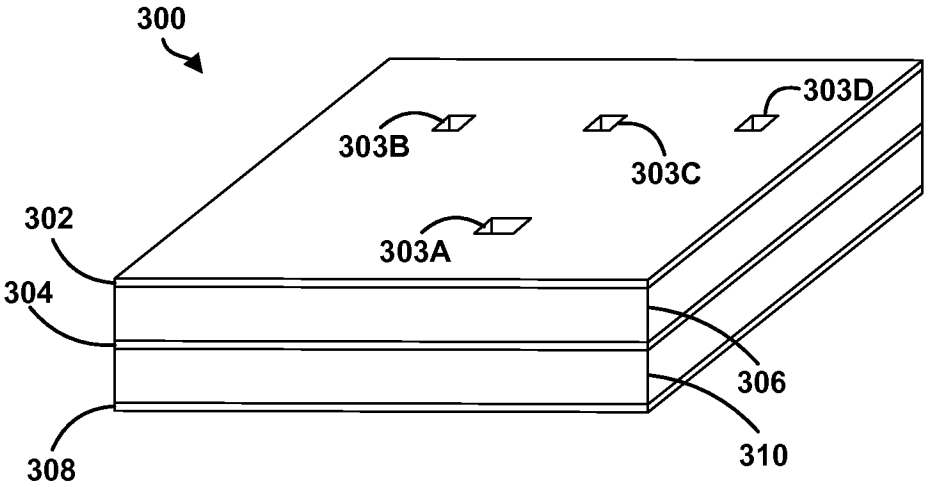
FIG. 3B illustrates an assembled view of the apparatus, in accordance with an example embodiment.

FIG. 3B illustrates an assembled view of the apparatus 300, in accordance with an example embodiment. The apparatus 300 shown in FIGS. 3A and 3B may be configured to function as a power divider or a Magic Tee, similar to the Magic Tee 100 described in FIG. 1. For example, the through-hole 303A in the first conducting layer may be configured to receive electromagnetic waves that are injected into the apparatus 300. The electromagnetic waves may be propagated through the through-hole 307A in the first layer 306 and the through-hole 305A in the second conducting layer 304 to the second waveguide channel 311B, i.e. the perpendicular leg of the T-shaped waveguide in the second layer 310.

The electromagnetic waves may then be propagated from the second waveguide channel 311B to the first waveguide channel 311A, i.e. the two collinear arms of the T-shaped waveguide, in the second layer 310. The electromagnetic waves may then be propagated through the through-holes 305B and 305D in the second conducting layer 304, the through-holes 307B and 307D in the first layer 306, and the through-holes 303B and 303D in the first conducting layer 302. Thus, the electromagnetic power injected into the through-hole 303A is divided and received at the through-holes 303B and 303D.

As another example, electromagnetic waves may be injected into the through-holes 303B and 303D in the first conducting layer 302. The electromagnetic waves may be propagated through the through-holes 307B and 307D in the first layer 306, and the through-holes 305B and 305D in the second conducting layer 304 to the first waveguide channel 311A (the two collinear arms of the T-shaped waveguide) in the second layer 310.

The electromagnetic waves may further propagate to and through the second waveguide channel 311B (the perpendicular leg of the T-shaped waveguide), where the electromagnetic waves may be combined (summed). The combined electromagnetic waves may propagate through the through-hole 305A, the through-hole 307A, and the through-hole 303A.

In this manner, the at least partially aligned through-holes in respective layers of the apparatus 300 may be configured to define electromagnetic wave paths or waveguides. For example, the through-holes 303D, 307D, and 305D may be configured to define an electromagnetic wave path or waveguide for propagating electromagnetic waves to and from the first waveguide channel 311A. Similarly, the through-holes 303B, 307B, and 305B may be configured to define an electromagnetic wave path for propagating electromagnetic waves to and from the first waveguide channel 311A. Also, the through-holes 303A, 307A, and 305A may be configured to define an electromagnetic wave path for propagating electromagnetic waves to and from the second waveguide channel 311B. Further, the through-holes 303C, 307C, and 305C may be configured to define an electromagnetic wave path for propagating electromagnetic waves to and from the first waveguide channel 311A and the second waveguide channel 311B (at the junction of the T-shaped waveguide). In some examples, the through-holes (e.g., 303D, 307D, and 305D) may be configured to define resonance coupling slots.

III. Example Layer Construction Details

Figure 3C:
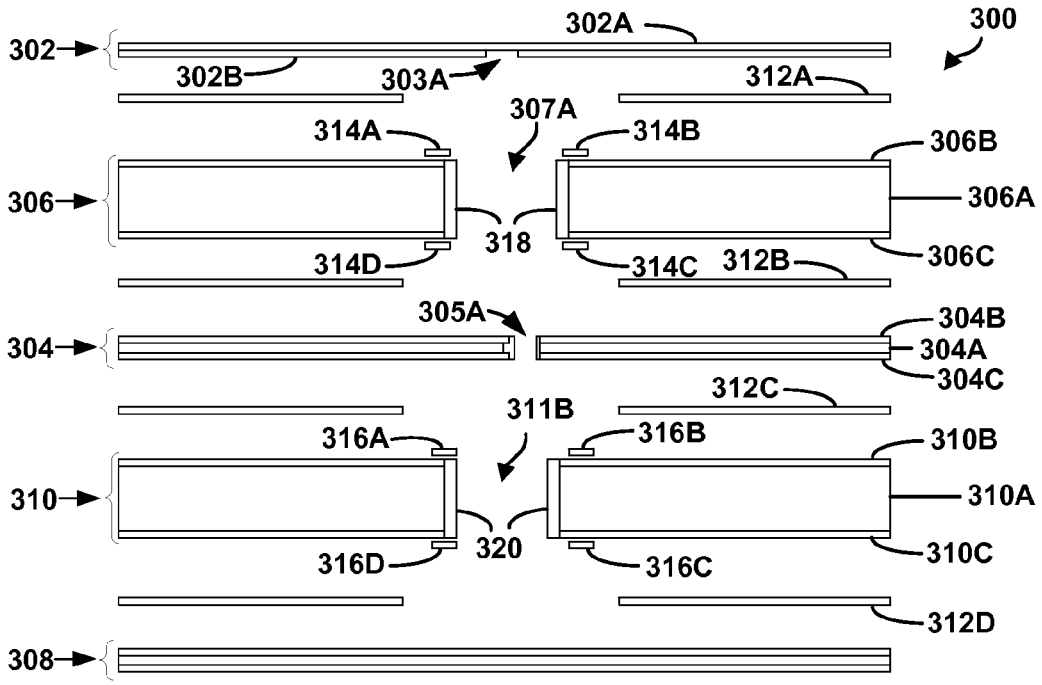
FIG. 3C illustrates an exploded view of a cross section of a layer stack of the apparatus, in accordance with an example embodiment.

FIG. 3C illustrates an exploded view of a cross section of a layer stack of the apparatus 300, in accordance with an example embodiment. FIG. 3C depicts example layer details not shown in the FIGS. 3A and 3B to further illustrate the fabrication and characteristics of the apparatus 300. In examples, adhesive layers may be positioned between the respective layers to couple the respective layers together. For example, adhesive layer 312A can be positioned between the first conducting layer 302 and the first layer 306; adhesive layer 312B can be positioned between the first layer 306 and the second conducting layer 304; adhesive layer 312C can be positioned between the second conducting layer 304 and the second layer 310; and adhesive layer 312D can be positioned between the second layer 310 and the third conducting layer 308. In some examples, a subset of the adhesive layers 312A, 312B, 312C, and 312D may be used.

Instead of, or in addition to, the adhesive layers 312A, 312B, 312C, and 312D, localized solder paste can be used as an adhesive. For instance, in FIG. 3C, solder paste 314A, 314B, 314C, and 314D can be used to couple the first layer 306 to the first conducting 302 and the second conducting layer 304. Similarly, solder paste 316A, 316B, 316C, and 316D can be used to couple the second layer 310 to the second conducting 304 and the third conducting layer 308. Locations of the solder paste in FIG. 3C are examples for illustration only. Other locations and configurations can be used.

As described above, at block 202 of the method 200, the first conducting layer 302 may be made of a conducting foil (e.g., a sheet of metal), or can be made of a Kapton layer coupled to a conducting layer (e.g., polyimide copper laminate). FIG. 3C depicts the latter configuration, where the first conducting layer 302 includes a Kapton layer 302A and a conducting layer 302B coupled to the Kapton layer 302A. Kapton is used herein as an example of a film layer, and any other material can be used. Similarly, the second conducting layers 304 and the third conducting layer 308 may be made of a metallic sheet or foil, or may be made of Kapton layer coupled to conducting layers. For example, the second conducting layer may include a Kapton layer 304A coupled to or laminated with two conducting layers (e.g., copper laminates) 304B and 304C.

As described above, at block 206 of the method 200, in some examples, the first layer 306 and the second layer 310 may be made of conducting material (e.g., metallic material such as aluminum or copper), and in other examples, may be made of dielectric material coupled to conducting sheets or layers. FIG. 3C illustrates the latter examples. For instance, the first layer 306 may be composed of a dielectric layer (FR-4) 306A coupled to two conducting layers (e.g., copper laminates) 306B and 306C. Similarly, the second layer 310 may be composed of a dielectric layer (FR-4) 310A coupled to two conducting layers (e.g., copper laminates) 310B and 310C. Electric signal traces may be formed or printed on the two conducting layers (e.g., using photolithography) to implement a given electric circuitry and associated functionalities, for example.

In some examples, the first layer 306 and the second layer 310 may not be made of the same material. For example, the first layer 306 may be made of a conducting material such as aluminum, and the second layer 310 may be made of FR-4 material coupled to two laminating conducting layers, or vice versa. Similarly, the first conducting layer 302 may be made of a material different from materials used for the second conducting material 304. For instance, the first conducting layer 302 may be made of a conducting material, while the second conducting material 304, or the third conducting layer 308, may be made of a Kapton layer coupled to two laminating conducting layers. Thus, different combinations of material can be used for the different layers of the apparatus 300.

In the example where the first layer 306 is composed of the dielectric material layer 306A coupled to the conducting layers 306B and 306C, forming the through-hole 307A in the dielectric layer 306A may expose non conducting inner surfaces. In this example, a metallic plating or deposit 318 may be provided on respective inner surfaces of the through-hole 307A in the layer 306A. Similarly, in the example where the second layer 310 is composed of a dielectric layer 310A coupled to the conducting layers 310B and 310C, forming the second waveguide channel 311B in the dielectric layer 310A may expose non-conducting inner surfaces. In this example, a metallic plating or deposit 320 may be provided on respective inner surfaces the second waveguide channel 311B in the second layer 310. Other through-holes and channels in the apparatus 300 can also be plated if respective layers are made of dielectric materials. The through-hole 307A and the second waveguide channel 311B were described herein as examples illustrated in the FIG. 3C.

Figure 3D:
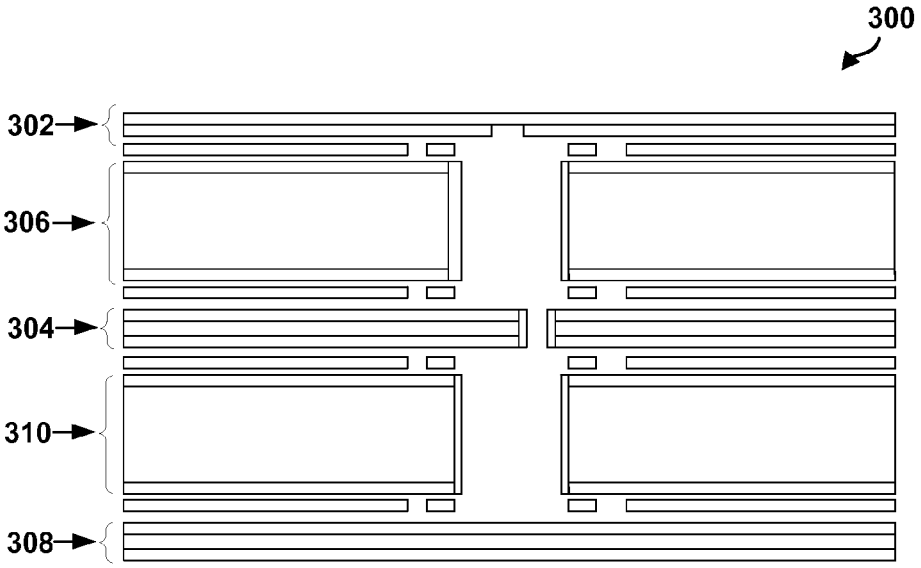
FIG. 3D illustrates an assembled view of the cross section of the layer stack of the apparatus, in accordance with an example embodiment.

FIG. 3D illustrates an assembled view of the cross section of the layer stack of the apparatus 300, in accordance with an example embodiment. In some examples, pressure can be applied to one or both of the outermost layers of the apparatus 300 (i.e., the first conducting layer 302 and the third conducting layer 308) to couple or bind the respective layers together using the adhesive layers 312A, 312B, 312C, and 312D, solder paste 314A, 314B, 314C, 314D, or solder paste 316A, 316B, 316C, 316D between the respective layers. In some examples, the adhesive layers 312A, 312B, 312C, and 312D may take the shapes and sizes of the layers 302, 304, 306, 308, or 310. In other examples, the adhesive layers 312A, 312B, 312C, and 312D may take shapes and sizes different from respective shapes and sizes of the layers 302, 304, 306, 308, or 310.

In some examples, pressure can be applied, by, for example, a plunger, on substantially an entire layer (e.g., the first conducting layer 302 and/or the third conducting layer 308) to couple the respective layers of the apparatus 300 together. In other examples, an adhesive material or solder paste can be applied at discrete locations between the respective layers of the apparatus 300 as depicted by the solder paste 314A, 314B, 314C, and 314D or 316A, 316B, 316C, and 316D. In these examples, a plunger can be used to apply pressure at the discrete locations. The adhesive material can be any type of adhesive appropriate for the material of the respective layers of the apparatus 300. As an example, the adhesive can include polymerizable material that can be cured to bond the layers together. Curing involves the hardening of a polymer material by cross-linking of polymer chains, and curing may be, for example, brought about by chemical additives, ultraviolet radiation, electron beam, and/or heat. In an example, the polymerizable material may be made of a light-curable polymer material that can be cured using ultraviolet (UV) light or visible light. In addition to light curing, other methods of curing are possible as well, such as chemical additives and/or heat. Any other type of adhesive and bonding method can be used to couple the respective layers of the apparatus 300 together.

FIGS. 3C and 3D show that the through-hole 303A may at least partially be aligned with the through-hole 307A and the through-hole 307A may at least partially be aligned with the through-hole 305A. The through-holes may be of different sizes. For example, the through-hole 307A may be of a different size compared to respective sizes of the through-holes 303A and 305A. Having through-holes of different sizes as depicted in FIGS. 3C and 3D may be used to tune resonance characteristics of the apparatus 300. As examples, the through-holes 305A, 305B, 305C, and 305D (of the second conducting layer 304) that connect the first waveguide channel 311A and the second waveguide channel 311B to the first layer 306 may be referred to as apertures or resonant slots. Dimensions of these resonant slots can be selected to tune resonance characteristics of the apparatus 300 such that resonance at a given frequency is avoided, for instance.

FIGS. 3A, 3B, 3C and 3D depict the third conducting layer 308 having no through-holes as an outermost layer of the apparatus 300. However, in other examples, the third conducting layer 308 may include through-holes similar to respective through-holes in the first conducting layer 302 and the second conducting layer 304. In these examples, other layers similar to the first layer 306 and the second layer 310 may be coupled to the third conducting layer 308. The other layers may have respective channels and/or through-holes. Thus, by adding more layers to the apparatus 300, a complex network of 3D interconnections can be created to receive and transmit electromagnetic waves.

Such a network of 3D interconnections can be implemented in complex electromagnetic systems such as Radar systems. A Radar system may include different subsystems composed of different components. For instance, a Radar antenna may be configured to act as an interface between the Radar system and free space through which radio waves may be transmitted and received. The antenna may be configured to transduce free space propagation to guided wave propagation during reception and the opposite during transmission. During transmission, the radiated energy may be concentrated into a shaped beam which points in a desired direction in space. During reception, the antenna may be configured to collect energy contained in an echo signal and deliver that energy to a receiver. The antenna and all or a subset of associated components of the Radar system may be integrated into a functional unit by stacking layers as described in FIGS. 3A, 3B, 3C, and 3D to form a network of 3D electromagnetic signal interconnections and implement functionality of the different components of the Radar system.

Examples herein of building a network of 3D interconnections based on layers as described above can also be used in other applications such as microwave ovens, satellite communications, high speed routers and cabling, and antenna systems, among others. Dimensions and sizes of the through-holes and waveguide channels in the different layers may be based on a given application. For instance, some example Radar systems may be configured to operate at an electromagnetic wave frequency of about 77 Giga Hertz (GHz), which corresponds to millimeter (mm) electromagnetic wave length. At this frequency, the through-holes and the waveguide channels of the apparatus 300 in FIGS. 3A-3D may be of given dimensions appropriate for the 77 GHz frequency. For an application operating at frequency that is an order of magnitude lower than the 77 GHz frequency, respective dimensions of the through-holes and the waveguide channels of the apparatus 300 may be an order of magnitude larger. Other examples are possible.

IV. Example T-Shaped Waveguide

Figure 4:
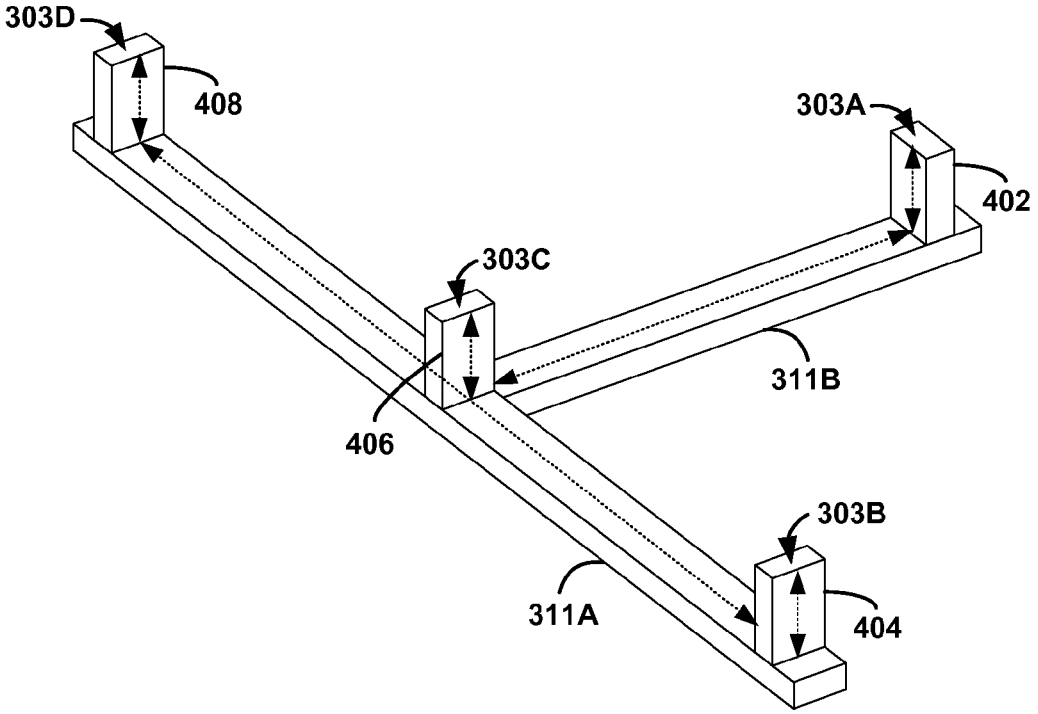
FIG. 4 illustrates a T-shaped waveguide and associated ports, in accordance with an example embodiment.

FIG. 4 illustrates a T-shaped waveguide and associated ports, in accordance with an example embodiment. FIG. 4 depicts internal paths and channels defined by the layers of the apparatus 300. For example, FIG. 4 shows the first waveguide channel 311A, the second waveguide channel 311B, and the through-holes 303A, 303B, 303C, and 303D. Additionally, FIG. 4 illustrates wave paths defined by respective through-holes in the respective layers of the apparatus 300. For example, wave path 402 depicts the path defined by the through-holes 303A, 307A, and 305A. Wave path 404 depicts the path defined by the through-holes 303B, 307B, and 305B. Wave path 406 depicts the path defined by the through-holes 303C, 307C, and 305C. Wave path 408 depicts the path defined by the through-holes 303D, 307D, and 305D. The wave paths 402, 404, 406, and 408 are shown to have uniform dimensions (e.g., consistent thickness). However, in other examples, the wave paths 402, 404, 406, and 408 may not be uniform if respective through-holes, defining a respective wave path, have different sizes with respective to each other. For instance, the through-holes 305A, 305B, 305C, and 305D in the second conducting layer 304 may have a smaller size compared to corresponding through-holes in the first conducting layer 302 and the first layer 306. Thus, the wave paths 402, 404, 406, and 408 may have smaller dimensions at respective bases where respective wave paths intersect with a respective waveguide channel (the first waveguide channel 311A or the second waveguide channel 311B).

Functionality of the T-shaped waveguide illustrated in FIG. 4 may be similar to respective functionality of the Magic Tee 100 described in FIG. 1. The second waveguide channel 311B corresponds to the arm 106 in FIG. 1. The first waveguide channel 311A forms side or collinear arms corresponding to arms 108 and arm 110 in FIG. 1. Together, the first waveguide channel 311A and the second waveguide channel 311B form an H-plane tee similar to the H-plane tee 104 in FIG. 1.

The wave path 406 (defined by the through-holes 305C, 307C, and 303C) corresponds to the arm 112 in FIG. 1. The wave path 406 along with the first waveguide channel 311A form an E-plane tee similar to the E-plane tee 102 depicted in FIG. 1. The through-hole 303A may correspond to the port 114, and may be referred to as the H-plane port,' 'sigma (E) port,' or 'sum port.' The through-hole 303C may correspond to the port 116, and may be referred to as 'E-plane port,' delta (Δ) port,' or 'difference port.' Similarly, the through-hole 303D may correspond to the port 120, and the through-hole 303B may correspond to the port 118.

The T-shaped waveguide depicted in FIG. 4 may be configured to function in a manner similar to the Magic Tee 100 in FIG. 1. For example, an electromagnetic signal injected in to the through-holes 303A (H-plane port) may propagate through the wave path 402, the second waveguide channel 311B, and the two collinear arms of the first waveguide channel 311A. The electromagnetic signal may thus be divided substantially equally between the through-hole 303B and the through-hole 303D. Divided signals going through the through-hole 303B and the through-hole 303D may be in phase.

In another example, a signal injected into the through-hole 303C (E-plane port) may similarly be divided substantially equally between the through-hole 303B and the through-hole 303D. But, the divided signals going through the through-hole 303B and the through-hole 303D may be 180° out of phase. In still another example, if signals are fed in through the through-holes 303B and 303D, the signals are added or combined at the through-hole 303A (H-plane port) and subtracted at the E-plane port 303C. Thus, in this example, the combination of the electromagnetic waves or signals is received at the through-hole 303A, and a difference of the electromagnetic waves or signals is received at the through-hole 303C. The double-sided dotted arrows in FIG. 4 indicate possible electromagnetic wave paths in the T-shaped waveguide. These functionalities are examples for illustration only. All other functionalities, properties, and characteristics of the Magic Tee 100 depicted in FIG. 1, can be performed by the apparatus 300.

Dimensions of the different through-holes and channels in respective layers of the apparatus 300 may be determined so as to tune performance of the Magic Tee and achieve accurate internal structure matching, port isolation, resonance characteristics, etc. In some examples, a given layer may not have one of the through-holes described in FIGS. 3A, 3B, 3C, and 3D. For instance, the second conducting layer 304 may not have the through-hole 305A in order to impute specific characteristics at the delta or difference port defined by the through-hole 303C. Other examples are possible.

Although the apparatus 300 shows a constructing a Magic Tee, the same fabrication technique can be used to build other components used in electromagnetic systems (e.g., Radar systems) such as Mixers, Baluns, and Balance Amplifiers. In examples, the different components can be integrated into a single stack of layers by adding layers, channels, through-holes (e.g., wave paths) to the stack of layer described in FIGS. 3A, 3B, 3C, and 3D.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims, along with the full scope of equivalents to which such claims are entitled. It is also to be understood that the terminology used herein is for the purpose of describing particular embodiments only, and is not intended to be limiting.

What is claimed is:

1. A method comprising:

forming a first conducting layer including a plurality of through-holes;

forming a second conducting layer including a plurality of through-holes;

forming, between the first conducting layer and the second conducting layer, a first layer including a plurality of through-holes, wherein the plurality of through-holes of the first layer are at least partially aligned with the plurality of through-holes of the first conducting layer and the plurality through-holes of the second conducting layer;

forming a third conducting layer;

forming, between the second conducting layer and the third conducting layer, a second layer that has a first waveguide channel and a second waveguide channel substantially perpendicular to and intersecting with the first waveguide channel, and wherein respective through-holes in the first conducting layer, the first layer, and the second conducting layer are configured to define respective electromagnetic wave paths to and from the first waveguide channel and the second waveguide channel; and providing a respective adhesive layer between one or more of: the first conducting layer and the first layer, the first layer and the second conducting layer, the second conducting layer and the second layer, and the second layer and the third conducting layer.

2. The method of claim 1, wherein the respective electromagnetic wave paths and the first waveguide channel and the second waveguide channels are configured to transmit millimeter electromagnetic waves.

3. The method of claim 1, wherein the first layer and the second layer comprise a dielectric material, the method further comprising:

providing a conductive material plating on respective inner surfaces of the plurality of through-holes of the first layer, and of the first waveguide channel and the second waveguide channel.

4. The method of claim 1, wherein the first layer and the second layer comprise a metallic material.

5. The method of claim 1, wherein the first waveguide channel and the second waveguide channel are configured to form a T-shaped waveguide, wherein the first waveguide channel is configured to form collinear arms of the T-shaped waveguide, and the second waveguide channel is configured to form a perpendicular leg of the T-shaped waveguide.

6. The method of claim 5, wherein the first conducting layer, the first layer, the second conducting layer, the second layer, and third conducting layer are configured to form a power divider, wherein at least one of the plurality of through-holes in the first conducting layer is configured to receive electromagnetic waves, wherein respective through-holes in the first layer and the second conducting layer are configured to propagate the electromagnetic waves, and the perpendicular leg of the T-shaped waveguide is configured to receive the propagated electromagnetic waves, and the perpendicular leg of the T-shaped waveguide is configured to further propagate the propagated electromagnetic waves to the collinear arms of the T-shaped waveguide, and wherein respective through-holes in the second conducting layer, the first layer, and the first conducting layer are configured to receive the electromagnetic waves from the collinear arms of the T-shaped waveguide.

7. The method of claim 5, wherein:

given through-holes of the plurality of through-holes in the first conducting layer are configured to receive electromagnetic waves, wherein respective through-holes in the first layer and the second conducting layer are configured to propagate the electromagnetic waves, and the collinear arms of the T-shaped waveguide channel are configured to receive the propagated electromagnetic waves, the perpendicular leg of the T-shaped waveguide is configured to receive the propagated electromagnetic waves from the collinear arms of the T-shaped waveguide and to combine the electromagnetic waves, wherein respective through-holes in the second conducting layer, the first layer, and the first conducting layer are configured to receive the combined electromagnetic waves from the perpendicular leg of the T-shaped waveguide, wherein an intersection of the perpendicular leg with the two collinear arms is configured to receive a difference of the electromagnetic waves, and wherein given respective through-holes in the second conducting layer, the first layer, and the first conducting layer are configured to receive the difference of the electromagnetic waves from the intersection.

8. An apparatus comprising:

a first conducting layer including a plurality of through-holes;

a second conducting layer including a plurality of through-holes;

a first layer between the first conducting layer and the second conducting layer, wherein the first layer includes a plurality of through-holes that are at least partially aligned with the plurality of through-holes of the first conducting layer and the plurality through-holes of the second conducting layer;

a second layer between the second conducting layer and a third conducting layer, wherein the second layer has a first waveguide channel and a second waveguide channel substantially perpendicular to and intersecting with the first waveguide channel, and wherein respective through-holes in the first conducting layer, the first layer, and the second conducting layer are configured to define respective electromagnetic wave paths to and from the first waveguide channel and the second waveguide channel; and a respective adhesive layer between one or more of: the first conducting layer and the first layer, the first layer and the second conducting layer, the second conducting layer and the second layer, and the second layer and the third conducting layer.

9. The apparatus of claim 8, wherein the respective electromagnetic wave paths and the first waveguide channel and the second waveguide channel are configured to propagate millimeter electromagnetic waves.

10. The apparatus of claim 8, wherein the first layer and the second layer comprise a dielectric material, and wherein a metallic material is deposited on respective inner surfaces of the plurality of through-holes of the first layer, and of the first waveguide channel and the second waveguide channel.

11. The apparatus of claim 8, wherein the first layer and the second layer comprise a metallic material.

12. The apparatus of claim 8, wherein the first waveguide channel and the second waveguide channel form a T-shaped waveguide, wherein the first waveguide channel forms collinear arms of the T-shaped waveguide, and the second waveguide channel forms a perpendicular leg of the T-shaped waveguide.

13. The apparatus of claim 12, wherein the first conducting layer, the first layer, the second conducting layer, the second layer, and third conducting layer form a power divider, wherein:

at least one of the plurality of through-holes in the first conducting layer is configured to receive electromagnetic waves, wherein respective through-holes in the first layer and the second conducting layer are configured to propagate the electromagnetic waves, and the perpendicular leg of the T-shaped waveguide is configured to receive the propagated electromagnetic waves, and the perpendicular leg of the T-shaped waveguide is configured to further propagate the propagated electromagnetic waves to the collinear arms of the T-shaped waveguide, and wherein respective through-holes in the second conducting layer, the first layer, and the first conducting layer are configured to receive the electromagnetic waves from the collinear arms of the T-shaped waveguide.

14. The apparatus of claim 12, wherein:

given through-holes of the plurality of through-holes in the first conducting layer are configured to receive electromagnetic waves, wherein respective through-holes in the first layer and the second conducting layer are configured to propagate the electromagnetic waves, and the collinear arms of the T-shaped waveguide channel are configured to receive the propagated electromagnetic waves, and the perpendicular leg of the T-shaped waveguide is configured to receive the propagated electromagnetic waves from the collinear arms of the T-shaped waveguide and to combine the electromagnetic waves, wherein respective through-holes in the second conducting layer, the first layer, and the first conducting layer are configured to receive the combined electromagnetic waves from the perpendicular leg of the T-shaped waveguide.

15. The apparatus of claim 8, wherein a size of respective through-holes in the first layer is different from a respective size of respective through-holes in the second conducting layer.

16. A method comprising:

forming a first conducting layer including a plurality of through-holes;

forming a second conducting layer including a plurality of through-holes; and forming, between the first conducting layer and the second conducting layer, a layer that has a first waveguide channel and a second waveguide channel substantially perpendicular to and intersecting with the first waveguide channel to form a T-shaped waveguide, wherein respective through-holes in the first conducting layer and the second conducting layer are configured to define respective electromagnetic wave paths to and from the first waveguide channel and the second waveguide channel; and providing an adhesive at edges of at least the second waveguide channel of the layer between the first conducting layer and the second conducting layer.

17. The method of claim 16, wherein the respective electromagnetic wave paths and the first waveguide channel and the second waveguide channel are configured to transmit millimeter electromagnetic waves.

18. The method of claim 16, wherein the layer comprises a dielectric material, the method further comprising:

providing a metallic material deposit on respective inner surfaces of the first waveguide channel and the second waveguide channel.

* * * * *